United States Patent [19]

Sekiguchi

[11] 4,270,869

[45] Jun. 2, 1981

[54] COMPOSITE WRITING INSTRUMENT

[75] Inventor: Kazuhiko Sekiguchi, Tokyo, Japan

[73] Assignee: Zebra Co., Ltd., Tokyo, Japan

[21] Appl. No.: 74,404

[22] Filed: Sep. 10, 1979

[51] Int. Cl.[3] ..... B43K 27/20

[52] U.S. Cl. ..... 401/30; 401/32

[58] Field of Search ..... 401/16, 17, 19, 20, 401/21, 29, 30, 32, 33, 99, 109, 110, 52, 67

[56] References Cited

U.S. PATENT DOCUMENTS

| | | | |
|---|---|---|---|
| 3,266,465 | 8/1966 | Ganz | 401/33 |
| 3,274,976 | 9/1966 | Levain | 401/109 X |
| 3,814,524 | 6/1974 | Sperti | 401/110 X |
| 3,898,008 | 8/1975 | Ganz | 401/30 |
| 3,989,389 | 11/1976 | Hashimoto et al. | 401/30 |
| 4,080,077 | 3/1978 | Schumacher | 401/32 X |

FOREIGN PATENT DOCUMENTS

| | | | |
|---|---|---|---|
| 2746409 | 4/1978 | Fed. Rep. of Germany | 401/30 |

*Primary Examiner*—Edward M. Coven

*Attorney, Agent, or Firm*—Wenderoth, Lind & Ponack

[57] ABSTRACT

A composite writing instrument having a lower tubular casing accommodating therewithin two retractable mechanical pencil units spaced by about 180°. An upper tubular casing encloses a cam mechanism for effecting a reciprocal rotational motion through about 180° around the axis of the instrument and engaging both pencil units for alternately shifting them in the axial direction whereby the two pencil units can be alternately advanced to a writing position through an opening at the lower end of the lower tubular casing, or retracted to a retracted position within the lower tubular casing. A feeding operation for advancing the lead of the pencil unit in the writing position is effected by reciprocating of the upper tubular casing in the axial direction.

2 Claims, 17 Drawing Figures

COMPOSITE WRITING INSTRUMENT

BACKGROUND OF THE INVENTION

The present invention relates to a composite writing instrument retractably accommodating two mechanical pencil units, for instance, two mechanical pencil units having different lead diameters, within a single tubular casing. In particular this composite writing instrument is characterized in that it comprises a lower tubular casing accommodating therewithin the two mechanical pencil units spaced by about 180°, and an upper tubular casing enclosing a cam mechanism for effecting a reciprocal rotational motion of about 180° around the axis of the lower tubular casing as well as engaging both mechanical pencil units for shifting the units alternately in the axial direction. The upper tubular casing is rotated around the axis for advancing one of the pencil units to a writing position where it projects out of the lower end of the lower tubular casing and retracting the other of the two pencil units to a retracted position within the lower tubular casing, and vice versa. An operation for feeding the lead of the pencil unit disposed in the writing position can be effected by reciprocating the upper tubular casing in the axial direction.

There has heretofore been known such a writing instrument which is provided with a lower tubular casing accommodating therewithin two different colored ball point pen units and an upper tubular casing enclosing a cam mechanism adapted to be engaged with said two ball point pen units, the upper tubular casing being reciprocally rotatable around the axis of the lower tubular casing through a certain angle for shifting the two pens units to a writing position or a retracted position. In this prior art structure of the writing instrument, however, the upper tubular casing is unable to be shifted in the axial direction of the lower tubular casing, so that even if a mechanical pencil unit is substituted for a ball point pen unit, the feeding action of the lead by and axial manipulation of the upper tubular casing cannot be effected.

SUMMARY OF THE INVENTION

The present invention was developed to overcome the foregoing problems, and provides a composite writing instrument wherein an upper tubular casing is rotated reciprocally around the axis thereof through about 180° for alternately shifting the respective two mechanical pencil units to a writing position and a retracted position, and wherein the upper tubular casing is able to be reciprocatingly shifted in the axial direction thereof for effecting feeding of the lead, so that the shifting of the two mechanical pencil units to a writing position can be carried out smoothly and reliably and lead can be fed easily with a simple construction.

BRIEF DESCRIPTION OF THE DRAWINGS

The present invention will be explained with reference to the drawings of the invention in which:

FIG. 6(*b*) is a sectional view taken along the line B—B of FIG. 1; FIG. 6(*c*) is a sectional view taken along the line C—C of FIG. 3; and FIG. 6(*d*) is a sectional view taken along the line D—D of FIG. 5;

DESCRIPTION OF THE PREFERRED EMBODIMENT

Figure 1:
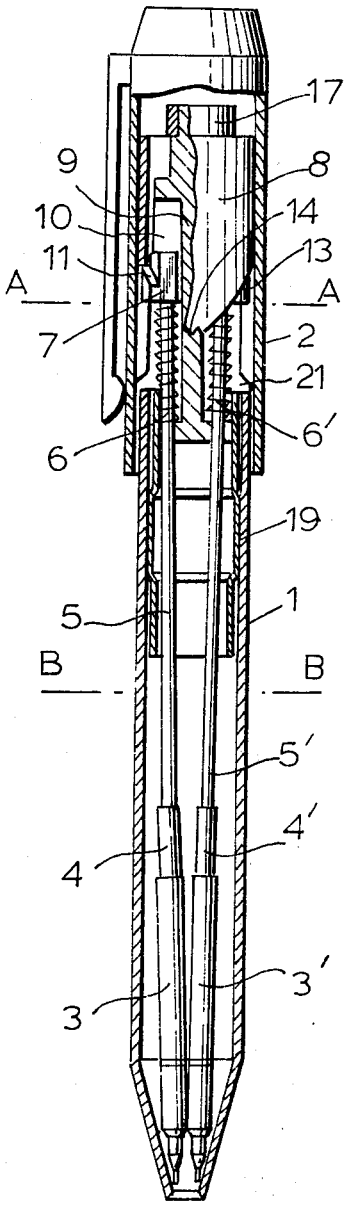
FIG. 1 is a longitudinal sectional view, partly broken away of the composite writing instrument according to the present invention showing the internal structure and with the two mechanical pencil units therewithin retracted to the retracted position.
Figure 2:
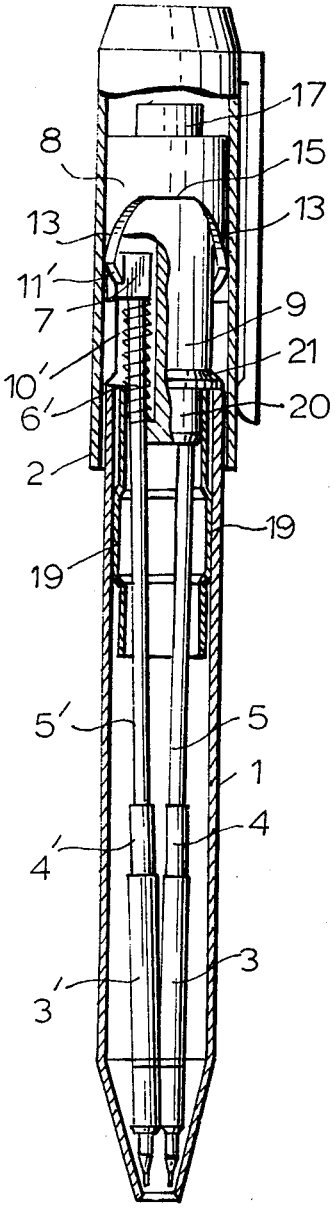
FIG. 2 is a view similar to FIG. 1 from the other side of the instrument as shown in FIG. 1.

In the drawings, the reference numeral 1 designates a lower tubular casing, within which are accommodated the main bodies 3 and 3' of mechanical pencil units (hereinafter called merely "pencil units"). Said two pencil units 3 and 3' are coupled at the rear end thereof rods 5 and 5' respectively through connecting sleeves 4 and 4', and sliders 7 and 7' are mounted on said rods 5 and 5' at the upper ends thereof.

In the upper part of said lower tubular casing 1 is tightly inserted a coupling sleeve 19 within which is tightly inserted the lower tubular part 20 of a guide sleeve 9. An annular projection 21 formed on said guide sleeve 9 is adapted to contact the lower tubular casing 1 at the upper end surface thereof to serve as stop. Thus, the lower tubular casing 1 has said guide sleeve 9 firmly connected thereto.

Figure 5:
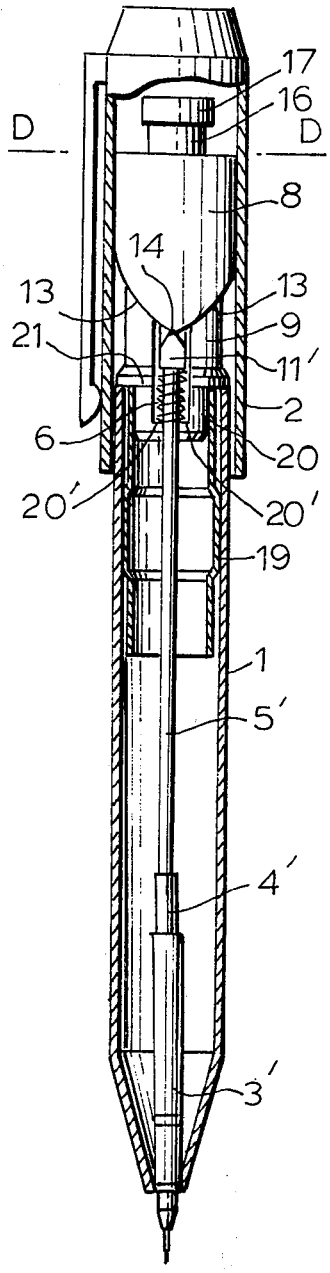
FIG. 5 is a view similar to FIG. 4 but at right angles to the view in FIG. 4.
Figure 6A:
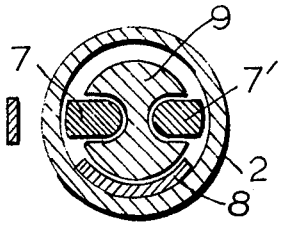
FIG. 6(*a*) is a sectional view taken along the line A—A of FIG. 1.
Figure 6B:
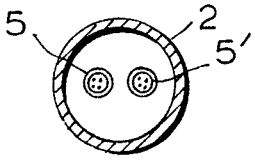
Figure 6C:
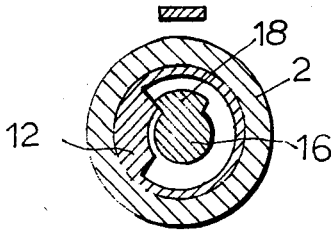
Figure 6D:
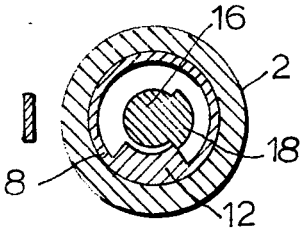

The guide sleeve 9 has a cylindrical shape and is provided with guide grooves 10 and 10' (refer to FIG. 10) which are mutually spaced at 180° in the circumferential direction of the casing in order to guide said sliders 7 and 7' in the axial direction of said sleeve. The sliders are held in these guide grooves 10 and 10' by coiled springs 6 and 6' respectively fitted on said rods 5 and 5' and are guided in a direction parallel to the axis of the casing along said guide grooves 10 and 10'. Said guide grooves 10 and 10' have a reduced width at the lower ends to form stepped portions 20', respectively (refer to FIG. 5 and FIG. 10), said coiled springs 6 and 6' being supported at the lower ends on said stepped portion 20'.

Figure 9:
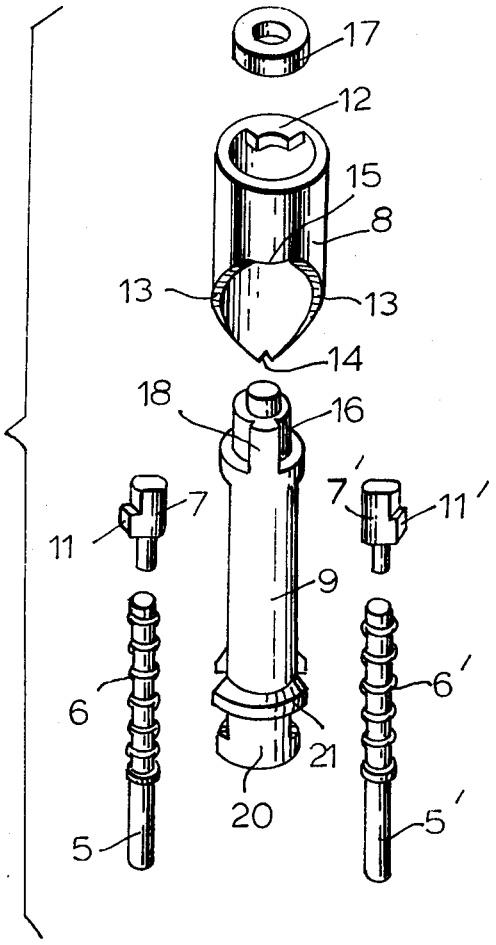
FIG. 9 is an exploded perspective view of the cam mechanism showing the individual elements thereof.
Figure 10E:
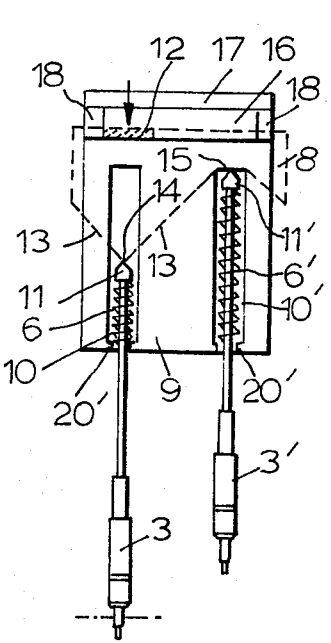
FIGS. 10(*a*) to (*e*) are diagrams showing the cam in developed form and the mechanical pencil units and their relative movements to the writing position, the retracted position and the lead feeding position in relation to the cam mechanism.
Figure 10D:
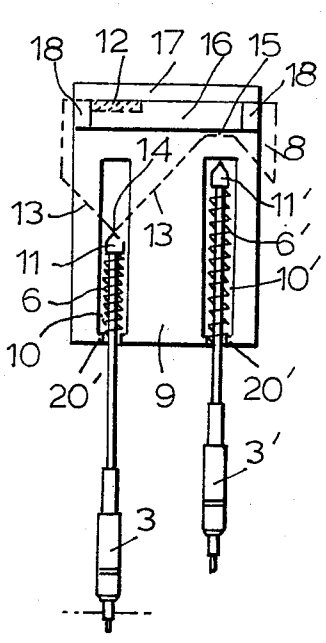
Figure 10C:
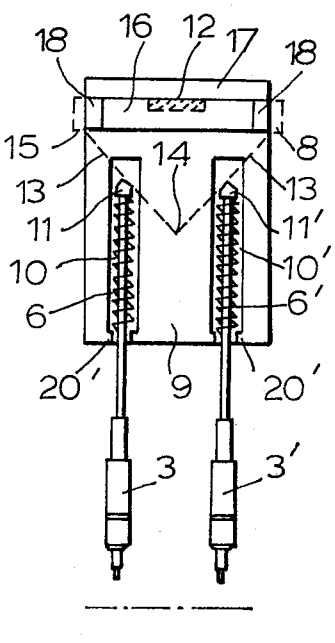
Figure 10B:
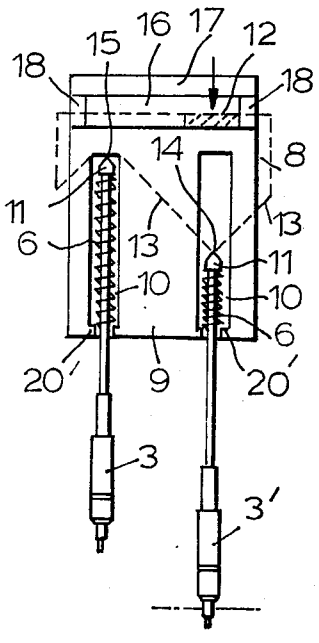
Figure 10A:
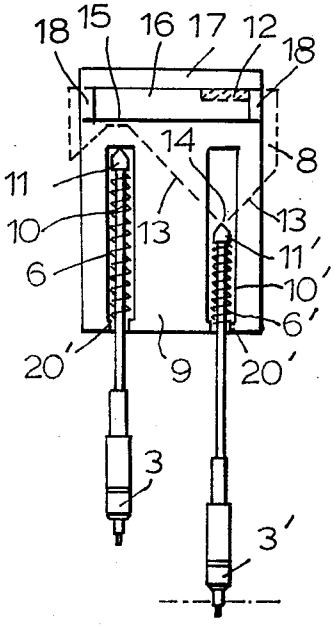

Said guide sleeve 9 has at the top portion thereof a stepped shaft head 16, and said shaft head 16 has on the peripheral side surface thereof a sector-shaped stop 18 extending through an angle of about 90° (refer to FIG. 9).

The guide sleeve 9 is, as shown in FIGS. 1 to 4 and FIG. 9, slidably inserted in the axial direction into a curved casing 8 and is rotatable therein. On the curved casing 8 is formed a cam face as is particularly apparent in FIG. 9. Said cam face, as is clearly illustrated in FIG. 6, has a flat portion 15 at the apex thereof which serves as a top face, and both ends of said top face are joined respectively with inclined faces 13 and 13 symmetrically extending downward to be confluent each other, and at the confluence of the two inclined faces 13 and 13 is formed a notched engaging portion 14. This notched engaging portion 14 is able to be engaged by the tip portions of pointed engaging portions 11 and 11' respectively formed on the surfaces of said sliders 7 and 7'. The inclined faces of said pointed portions 11 and 11' are adapted to be slidably engaged with said inclined cam face during the rotational motion of said curved casing 8 so as to slide on said cam face. The flat portion 15 is above the upper ends of the grooves 10 and 10'.

Figure 7:
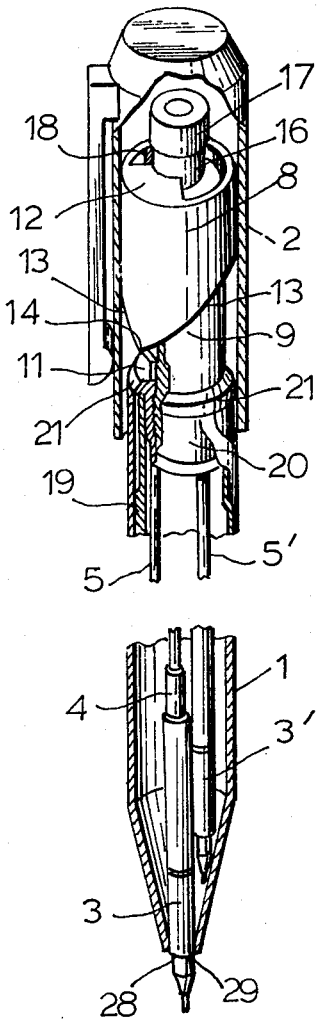
FIG. 7 is a perspective view, partly broken away, with the parts in the same positions as in FIGS. 3 and 5.

A sector-shaped stop 12 extending through an angle of about 90° projects inwardly from the inner periphery of the upper end of the curved casing 8 as clearly seen in FIG. 6, FIG. 7 and FIG. 9 respectively. Said sector shaped stop 12 is engaged with the stop 18 on said shaft head 16 as will be described hereinafter.

Figure 3:
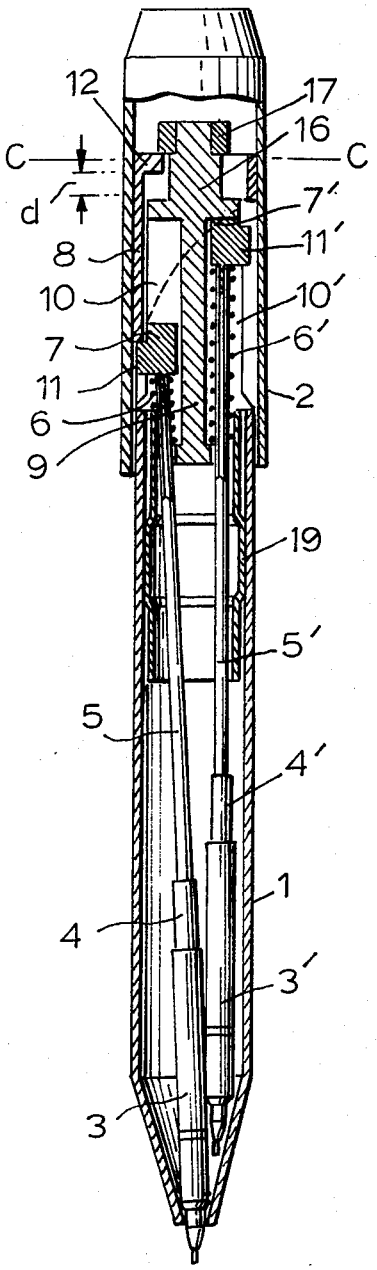
FIG. 3 is a view similar to FIG. 1 with one of the two mechanical pencil units.
Figure 4:
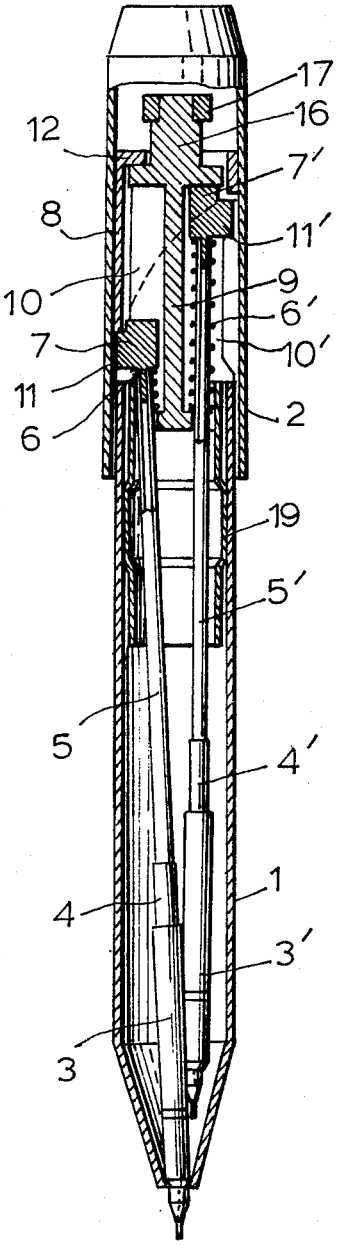
FIG. 4 is a view similar to FIG. 3 showing the upper tubular casing shifted downward in the axial direction in order to feed the lead of the pencil unit which is in the writing position.

A fixing ring 17 is fitted on the shaft head 16 after the curved casing 8 has been put on the outside of the guide sleeve 9 as shown in FIG. 3 and FIG. 4. Said fixing ring 17 cooperates with the sector shaped stop 12 and serves to check the upward movement of said curved casing 8 by virtue of the resilient force of the coiled springs 6 and 6'.

Figure 8:
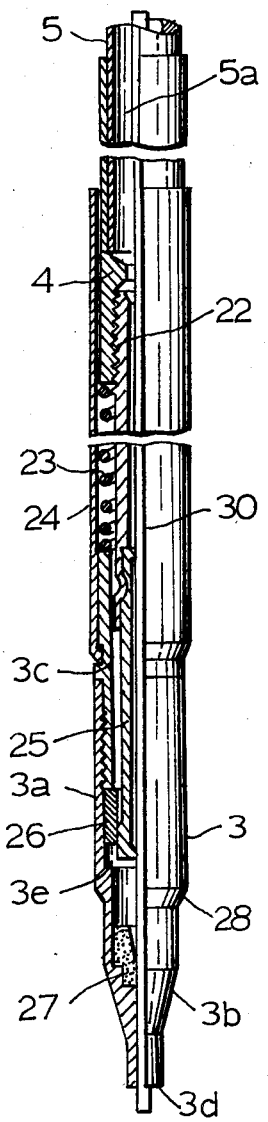
FIG. 8 is a fragmentary elevational view, partly in section, of the mechanical pencil unit showing the internal mechanism thereof.

The upper tubular casing 2 is securely engaged with the outside of said curved casing 8, and the upper tubular casing overlaps the lower tubular casing 1 at the lower end of the upper tubular casing so that the two casings are slidable relative to each other. Since the curved casing 8 is, as is explained later, rotatable in respect to the guide sleeve 9 through 180° with the aid of said sector-shaped stops 12 and 18, the upper tubular casing 2 is also capable of effecting reciprocal rotational motion through 180° relative to the lower tubular casing 1, and it is further slidable through a certain limited distance in the axial direction thereof (a detailed description of this will be given hereinafter). The pencil bodies 3 and 3' both have chuck mechanism as shown in FIG. 8. The rod 5 serves as a magazine for the lead 30. A connecting sleeve 4 is fitted over the outer periphery of the lower part of the rod 5, said connecting sleeve 4 being at the lower part thereof, said connecting sleeve 4 being fixed to an intermediate sleeve 22, and a split pawl chuck 25 is securely attached to said intermediate sleeve 22. On the tip of the pencil body casing **3*a* is formed a pencil tip mouth piece 3*b*. Said casing 3*a* is coupled at the upper part thereof to a connecting tube 3*c*, and a spring 23 is positioned between the upper end of said connecting tube 3*c* and the lower end of said connecting sleeve 4. Said connecting sleeve 4 and connecting tube 3*c* are shielded by means of casing 24 forming a part of the pencil body casing 3*a*. A clamping sleeve 26 cooperating with the chuck 25 is accommodated within a space formed between the lower end of the connecting tube 3*c* and an abutting stepped portion 3*e* and is axially slidable in said space, and the interior of said clamping sleeve 26 is outwardly tapered toward the tip mouth piece 3*b*. The reference numeral 27 represents a rubber-like elastic supporting ring mounted within said tip mouth piece 3*b*. An abutting stop portion 28 is formed on the upper portion of the outside of said tip mouth piece 3*b* for engagement with the inner edge of the opening 29 at the lower end of the lower tubular casing when the pencil body 3 is shifted toward the opening 29 of the lower tubular casing 1 in order to feed the lead out of the pencil unit. The manner of feeding the lead 30** by the chuck mechanism will be described hereinafter.

Next, the manner of displacement for advance of a pencil unit to the writing position and retraction to the retracted position will be described with reference to FIG. 10.

FIG. 10(*c*) shows the state of said two pencil bodies 3 and 3' when they are in the retracted position. In this position, the inclined faces of the pointed engaging portions 11 and 11' mounted on the ends of the rods 5 and 5' and guided along the guide grooves 10 and 10' provided in the guide sleeve 9, are in resilient contact with the curved casing 8 near the middle of the inclined faces 13 by virtue of the action of said coiled springs 6 and 6'. In this condition however, the sector-shaped stop 12 is located on the curved casing 8 at the top thereof is not in contact with the sector shaped stop 18 on the shaft head 16, but is located at a neutral position. The chain line below the mechanical pencil units 3 and 3' indicates the position of the opening 29 at the lower end of the tubular casing 1.

First, in order to advance the pencil unit 3' to the writing position, the upper tubular casing 2 and the curved casing 8 securely fitted thereto are rotated to the position shown in FIG. 10(*a*), in other words, a position where the sector-shaped stop 12 comes into contact with the other stop 18 as shown in FIG. 6(*d*). During the foregoing rotational motion of the curved casing being actuated, the inclined face of the pointed engaging portion 11 provided on the rod 5 on the pencil unit 3 slides upward along the inclined face 13 of the curved casing 8, and before the pointed engaging portion reaches the apex, it reaches the upper end groove 10 and the pointed engaging portion 11 is separated from the inclined face 13 and is positioned at a position below the flat portion 15. The pointed engaging portion 11' or the other pencil body 3' slides downward along the other inclined face 13 of the curved casing 8 until it reaches the lower end of the face and it is then engaged in said notched engaging portion 14 (refer to FIG. 5). At this point, the top face of the sector-shaped stop 12 has come into contact with the lower face of the fixing ring 17 by virtue of the biasing force of the coiled spring 6', thus forming a clearance d between the top face of the guide sleeve 9 and the lower face of sector-shaped stop 12. Said clearance d corresponds to the downward shifting stroke of the upper tubular casing 2 for feeding lead. In FIG. 10(*a*), the pencil unit 3' has been moved to the writing position.

As described hereinbefore, since the sector-shaped stop 12 of the curved casing 8 is in contact with the lower face of the fixing ring 17 due to the biasing force of the coiled spring 6', the clearance d exists when the two pencil bodies are positioned as shown in FIG. 10(*a*), so that, by pushing the upper tubular casing 2, and the curved casing 8 downward in the axial direction indicated by the arrow, the pencil unit 3' can be shifted freely to the position shown in FIG. 10(*b*) without any obstruction in the direction indicated by the arrow. As set forth above, the distance d is predetermind in such a manner that the stroke of said pencil unit 3' caused by the displacement of said curved casing 8 in the axial direction indicated by the arrow is adapted to correspond to the distance which causes a lead feeding operation by the abutment of the stop portion 28 of the pencil unit 3 with the edge of the opening 29 in the lower tubular casing 1. After the upper tubular casing 2 is pushed in the axial direction, it is released, whereby the lead feeding operation of the pencil unit 3' is performed smoothly and reliably.

Second, in order to shift the pencil unit 3 forwardly to the writing position, the curved casing 8 is rotated to the position shown in FIG. 10(*d*) 180° from the position shown in FIG. 10(*a*) and 90° from the position shown in FIG. 10(*c*). The description of the on movement of the pencil units 3 and 3' to the respective positions shown in FIG. 10(*d*) as well as the displacement of the curved casing 8 in the direction indicated by the arrow shown in FIG. 10(*e*) is omitted because the movement and displacement of the pencil units 3 and 3' because they will be clear from the description given with reference to FIGS. 10(*a*) and (*b*).

The lead feeding operation of the pencil units 3 and 3' will now be explained with reference to FIG. 8. When the pencil unit 3 is shifted to the writing position shown in FIG. 10(*d*) and with the lower tubular casing 1 being stationary for displacing the upper tubular casing 2 the curved casing 8 in the direction indicated by the arow by a pushing force, the pencil unit 3 is displaced further downward as shown in FIG. 10(*e*), and the stop portion 28 of said pencil unit 3 comes into contact with the edge of the opening 29 in the lower tubular casing 1 as shown in FIG. 7. The when the curved casing 8 is shifted downward, the connecting sleeve 4 coupled with the rod 5 slides toward the tip of the pencil unit with respect to the cover casing 24 against the resilient force of the spring 23. Along with the sliding motion of the connecting sleeve 4 an intermediate shift sleeve 22 coupled with the connecting sleeve 4 as well as a split pawl chuck 25 are shifted together toward the tip of the pencil unit, where the lead 30 held by the split pawl chuck 25 cooperating with the clamping sleeve 26 is fed to the tip side of the pencil unit so as to protrude therefrom. When the split pawl chuck 25 is moved further toward the tip of the pencil unit, however, the clamping sleeve 26 being shifted together with said chuck 25 is brought into contact with the stepped portion 3*e* and further movement thereof is blocked, so that said split pawl chuck 25 is separated from the clamping sleeve 26, and the lead 30 is released from the holding action of said chuck 25. Thus, the lead 30 is fed so as to protrude through the tip mouth 3*d* corresponding to the shift distance of said clamping sleeve 26. Subsequently, when the upper tubular casing 2 is released, the chuck 25, the intermediate shift sleeve 22, the connecting sleeve 4 and the rod 5 respectively are restored to their initial positions by the spring 23 and the lead 30 is held by the elastic supporting ring 27, and thus the chuck 25 is adapted to hold the lead 30 tightly again. By repetition of the reciprocating action caused by pushing the upper tubular casing 2, the lead 30 can be fed to a position favourable for writing through the mouth 3*d* of the tip 3*b*. Also, spare leads may be stored in the shaft 5*a* of the rod 5, and these spare leads can be continuously fed in succession. Replenishment of said spare leads in the cavity 5*a* of the rod 5 can be effected by making the connecting sleeve 4 disengageable from the rod 5.

Thus the present invention is able to provide a composite writing instrument having an extremely simple structure and excellent durability which is highly effective for practical use, wherein two pencil units can be smoothly and reliably delivered to either the writing or the retracted position by rotating the upper tubular casing. By shifting the upper tubular casing in the axial direction thereof the lead feeding operation can be carried out.

What is claimed is:

1. A composite writing instrument comprising:

a lower tubular casing having openings at the upper and lower ends thereof;

a guide sleeve fixed in the opening at the upper end of said lower tubular casing and having two longitudinal guide grooves therein located diametrically opposite each other, and further having a shaft head at the top thereof and a stop on the periphery of said head;

two mechanical pencil units within said lower tubular casing at diamterically opposite positions and having writing tips directed toward the opening in the lower end of said lower tubular casing, a slider at the other end of each pencil unit engaged in a corresponding one of said two guide grooves in said guide sleeve, each of said mechanical pencil units having a pencil casing having a pencil tip mouth piece, a rod accommodated within said pencil casing and shiftable in the axial direction thereof and a connecting sleeve coupled with said rod, a split pawl chuck for gripping a lead on said connecting sleeve at the tip thereof, said chuck having a clamping ring which is engaged with and cooperates with said chuck in a defined range of movement therewith;

a curved casing having on the top portion thereof a segment-shaped stop engageable with said stop on said guide sleeve, said curved casing further being reciprocally rotatable around said guide sleeve between two extreme rotational positions and being shiftable in the axial direction along said sleeve, said curved casing further having a cam face on the lower end thereof having an upper flat portion and inclined faces extending downwardly symmetrically from both ends of said upper flat portion and converging in a notched engaging portion, each of said inclined faces being engaged by corresponding slider units during rotational motion of said curved casing for respectively shifting said two mechanical pencil units in the axial direction to a writing position in which the writing tip thereof projects from said lower tubular casing and a retracted position at the respective extreme positions of said limited rotational motion, the units at the intermediate point in said rotational motion being accommodated within said lower casing at a neutral position, and said guide grooves terminating below said upper flat portion for stopping said pencil units in the retracted positions at a position below the cam face to leave a clearance permitting axially downward shifting of said curved casing without contact with the retracted pencil unit;

an upper tubular casing mounted on and covering said curved casing and shielding the upper end of said lower tubular casing and rotatable and axially shiftable with said curved casing;

said stop on the guide sleeve and said segment-shaped stop on the curved casing being engageable with each other at the extreme rotational positions for limiting the reciprocal rotation of said curved casing around the axis thereof with respect to said sleeve to approximately 180°;

whereby when one of said pencil units is shifted to a writing position, the upper tubular casing can be shifted toward the lower tubular casing and said shifting motion is transmitted to the slider, the rod, the coupling sleeve and the pencil pawl chuck of the one pencil unit for nipping the lead of the mechanical pencil unit to acutate said pawl chuck so as to project the lead by means of said chuck in cooperation with the clamping ring of the one pencil unit.

2. A composite writing instrument as claimed in claim 1 in which the stop on the guide sleeve has radial side faces contacted by the segment-shaped stop on said curved casing at the extreme rotational positions for limiting said reciprocal rotation of said curved casing to approximately 180°.

* * * * *